US005258117A

United States Patent [19]

Kolstad et al.

[11] Patent Number: 5,258,117

[45] Date of Patent: * Nov. 2, 1993

[54] MEANS FOR AND METHODS OF REMOVING HEAVY BOTTOMS FROM AN EFFLUENT OF A HIGH TEMPERATURE FLASH DRUM

[75] Inventors: Jeffrey J. Kolstad, Wayzata, Minn.; William I. Beaton, Wheaton; James L. Taylor, Naperville, both of Ill.

[73] Assignee: Amoco Corporation, Chicago, Ill.

[ * ] Notice: The portion of the term of this patent subsequent to Jul. 20, 2010 has been disclaimed.

[21] Appl. No.: 824,509

[22] Filed: Jan. 23, 1992

Related U.S. Application Data

[63] Continuation-in-part of Ser. No. 616,208, Nov. 20, 1990, Pat. No. 5,124,026 Ser. No. 616,281, Nov. 20, 1990, Pat. No. 5,124,027, and Ser. No. 616,219, Nov. 20, 1990, Pat. No. 5,124,025, each is a continuation-in-part of Ser. No. 381,372, Jul. 18, 1989, Pat. No. 5,013,427.

[51] Int. Cl.[5] ..... E10G 53/04; E10G 55/02

[52] U.S. Cl. ..... 208/309; 208/86; 208/87; 208/89; 208/92; 208/96; 208/221; 208/222; 208/313; 208/339; 208/314; 208/315; 208/317

[58] Field of Search ..... 208/86, 87, 92, 96

[56] References Cited

U.S. PATENT DOCUMENTS

| | | | |
|---|---|---|---|
| 4,686,027 | 8/1987 | Bonilla et al. | 208/87 |
| 4,940,529 | 7/1990 | Beaton et al. | 208/87 |
| 5,013,427 | 5/1991 | Mosby et al. | 208/87 |
| 5,089,114 | 2/1992 | Tovar | 208/87 |

*Primary Examiner*—Helane Myers

*Attorney, Agent, or Firm*—Scott P. McDonald; Thomas T. Tolpin; Frank J. Sroka

[57] ABSTRACT

A process for improving the performance of heavy oil refining units in a resid hydrotreating unit equipped for resid hydrotreating. The partially refined resid stream issuing from a train of ebullated bed reactor is first separated into high, medium, and low temperature components. The high temperature component is sent through a flash drum and then fractionated by solvent deasphalting in order to provide oil, resin, and asphaltene fractions. Thus, the asphaltene is eliminated before it can foul downstream equipment. This treatment of the heavy oil product has several benefits as compared to treating the vacuum tower bottoms. Among other things, one of these benefits is to debottleneck the resid hydrotreating unit, especially at the atmospheric tower.

32 Claims, 7 Drawing Sheets

MEANS FOR AND METHODS OF REMOVING HEAVY BOTTOMS FROM AN EFFLUENT OF A HIGH TEMPERATURE FLASH DRUM

This is a continuation-in-part of Ser. Nos. 07/616,208 now U.S. Pat. No. 5,124,026;; 07/616,281 now U.S. Pat. No. 5,124,027; and 07/616,219 now U.S. Pat. No. 5,124,025 each of which was filed Nov. 20, 1990 each of which, in turn, was a continuation-in-part of Ser. No. 07/381,372 filed Jul. 18, 1989, now U.S. Pat. No. 5,013,427 issued May 7, 1991.

This invention relates to means for and methods of preventing downstream fouling in resid hydrotreating unit systems and more particularly, to means for relieving burdens upon downstream distillation towers by an upstream separation of heavy bottoms from a high temperature flash drum.

Much of the system disclosed herein is taken from U.S. Pat. No. 5,013,427, which may be consulted for further information. To help the reader, the same reference numerals are used both herein and in U.S. Pat. No. 5,013,427. A companion patent is U.S. Pat. No. 4,940,529.

REFERENCE TO PRIOR ART

Over the years, a variety of processes and equipment have been suggested for use in various refining operations, such as for upgrading oil, hydrotreating, reducing the formation of carbonaceous solids in hydroprocessing, and catalytic cracking. Typifying some of these prior art processes and equipment are those described in U.S. Pat. Nos. 2,382,282; 2,398,739; 2,398,759; 2,414,002; 2,425,849; 2,436,927; 2,692,222; 2,884,303; 2,900,308; 2,981,676; 2,985,584; 3,004,926; 3,039,953; 3,168,459; 3,338,818; 3,351,548; 3,364,136; 3,513,087; 3,563,911; 3,661,800; 3,766,055; 3,798,157; 3,838,036; 3,844,973; 3,905,892; 3,909,392; 3,923,636; 4,191,636; 4,239,616; 4,290,880; 4,305,814; 4,331,533; 4,332,674; 4,341,623; 4,341,660; 4,354,922; 4,400,264; 4,454,023; 4,486,295; 4,478,705; 4,495,060; 4,502,944; 4,521,295; 4,526,676; 4,592,827; 4,606,809; 4,617,175; 4,618,412; 4,622,210; 4,640,762; 4,655,903; 4,661,265; 4,662,669; 4,692,318; 4,695,370; 4,673,485; 4,681,674; 4,686,028; 4,720,337; 4,743,356; 4,753,721; 4,767,521; 4,769,127; 4,773,986; 4,808,289; and 4,818,371.

DEFINITIONS

The term "asphaltenes" as use herein means a heavy polar fraction and are the residue which remains after the resins and oils have been separated from resid in a deasphalting unit. Asphaltenes from vacuum resid are generally characterized as follows: a Conradson or Ramsbottom carbon residue of 30 to 90 weight % and a hydrogen to carbon (H/C) atomic ratio of 0.5% to less than 1.2%. Asphaltenes can contain from 50 ppm to 5000 ppm vanadium and from 20 ppm to 2000 ppm nickel. The sulfur concentration of asphaltenes can be from 110% to 250% greater than the concentration of sulfur in the resid feed oil to the deasphalter. The nitrogen concentration of asphaltenes can be from 100% to 350% greater than the concentration of nitrogen in the resid feed oil to the deasphalter.

The term "resins" as used herein means resins that are denser or heavier than the deasphalted oil and comprise more aromatic hydrocarbons with highly substituted aliphatic side chains. Resins also comprise metals, such as nickel and vanadium, and comprise more heteroatoms than deasphalted oil. Resins from vacuum resid can be generally characterized as follows: a Conradson or Ramsbottom carbon residue of 10 to less than 30 weight % and a hydrogen to carbon (H/C) atomic ratio of 1.2% to less than 1.5%. Resins can contain 1000 ppm or less of vanadium and 300 ppm or less of nickel. The sulfur concentration in resins can be from 50% to 200% of the contraction of sulfur in the resid oil feed to the deasphalter. The nitrogen concentration in resins can be from 30% to 250% of the concentration of nitrogen in the resid oil feed in the deasphalter.

The term "solvent-extracted oil" ("SEO")as used herein means substantially deasphalted, deresined (resin-free) oil which has been separated and obtained from a solvent extraction unit.

The terms "resid oil" and "resid" as used herein mean residual oil.

As used herein, the terms "deasphalting unit" and "deasphalter" mean one or more vessels or other equipment which are used to separate oil, resins, and asphaltenes.

The term "solvent extraction unit" ("SEU") as used herein means a deasphalter in which resid is separated into oil, resins, and asphaltenes by means of one or more solvents.

The term "deasphalted oil" as used herein means oils that are generally the lightest or least dense products produced in a deasphalting unit and comprise saturate aliphatic, alicyclic, and some aromatic hydrocarbons. Deasphalted oil generally comprises less than 30% aromatic carbon and low levels of heteroatoms except sulphur. Deasphalted oil from vacuum resid can be generally characterized as follows: a Conradson or Ramsbottom carbon residue of 1 to less than 12 weight % and a hydrogen to carbon (H/C) ratio of 1.5% to 2%. Deasphalted oil can contain 50 ppm or less, preferably less than 5 ppm, and most preferably less than 2 ppm, of vanadium and 50 ppm or less, preferably less than 5 ppm, and most preferably less than 2 ppm of nickel. The sulfur and nitrogen concentrations of deasphalted oil can be 90% or less of the sulfur and nitrogen concentrations of the resid feed oil to the deasphalter.

Decanted oil ("DCO") is a valuable solvent and is used in the resid hydrotreating unit for controlling the formation of carbonaceous solids therein. However, decanted oil is normally obtained from a catalytic cracking unit and contains cracking catalyst solids or fines therein. These fines are small particles made up of the catalyst used in the catalytic cracking unit.

The term "fine-lean DCO", or "fine-free DCO" as used herein, means decanted oil having less than 20 ppm silica and less than 20 ppm alumina.

BACKGROUND OF THE INVENTION

Known resid hydrotreating systems produce carbonaceous solids which foul separators, stills, and other downstream processing units. Therefore, it is both desirable and advantageous to remove these solids from the hydrotreated effluent as early as possible in the refining process and at the first convenient opportunity, especially before the temperature of the effluent is reduced significantly.

The prior art discloses distilling light and heavy vacuum gas oil from the effluent prior to deasphalting. While this distillation tends to minimize the load on the solvent extraction unit, the practice also requires a vacuum tower. Also, since certain streams from a deasphalter ("SEU") are subsequently commingled with vacuum gas oils, the distillation process steps are somewhat redundant. Further, the hydrotreated effluent is cooled prior to fractionation which contributes to the downstream fouling.

BRIEF DESCRIPTION OF THE INVENTION

Accordingly, an object of the invention is to reduce fouling a product recovery train of a resid hydrotreating unit ("RHU") and to reduce fouling of the RHU in response to a recycling of products to the hydrotreater. In particular, for a new RHU, an object is to reduce the amount of equipment needed in a downstream product recovery train of a RHU and to reduce the fouling of the RHU in response to a recycling of products to the hydrotreater.

Yet another object of the invention is to provide means for separating hydrotreater effluent into fractions so that these fractions can be more efficiently converted to light oils in downstream processes.

Still another object of the invention is to provide a recycle stream to the RHU which is highly reactive and causes little fouling. In this connection, an object is to provide a means for removing fines from decanted oil and other dilutents so that the dilutents may be fed to the RHU with a reduced propensity to form carbonaceous solids.

In keeping with an aspect of this invention, these and other objects are accomplished by a deasphalting/hydrotreating process which is added at the output of a high temperature flash drum for improved heavy oil processing. The heavy oil product from the hot separator flash drum of the resid hydrotreating unit is fractionated by solvent deasphalting into oil, resin, and asphaltene fractions. This treating of the heavy oil product has several benefits as compared to treating the vacuum tower bottoms. The inventive process provides a deasphalting unit in order to improve resids for recycling, asphalt for solid fuel, and oils for catalytic cracking. The invention also provides the benefit of debottlenecking the atmospheric tower. Then the usual vacuum tower either becomes unnecessary or available for other purposes.

BRIEF DESCRIPTION OF THE DRAWING

A preferred embodiment of the invention is shown in the attached drawings in which:

FIG. 6 is an incorporation of the solvent extractor of FIG. 5 in the system used in the resid hydrotreating unit of FIG. 1.

Some of these figures are taken from and other are modifications of figures in U.S. Pat. No. 5,013,427.

DETAILED DESCRIPTION OF THE INVENTION

Figure 1:
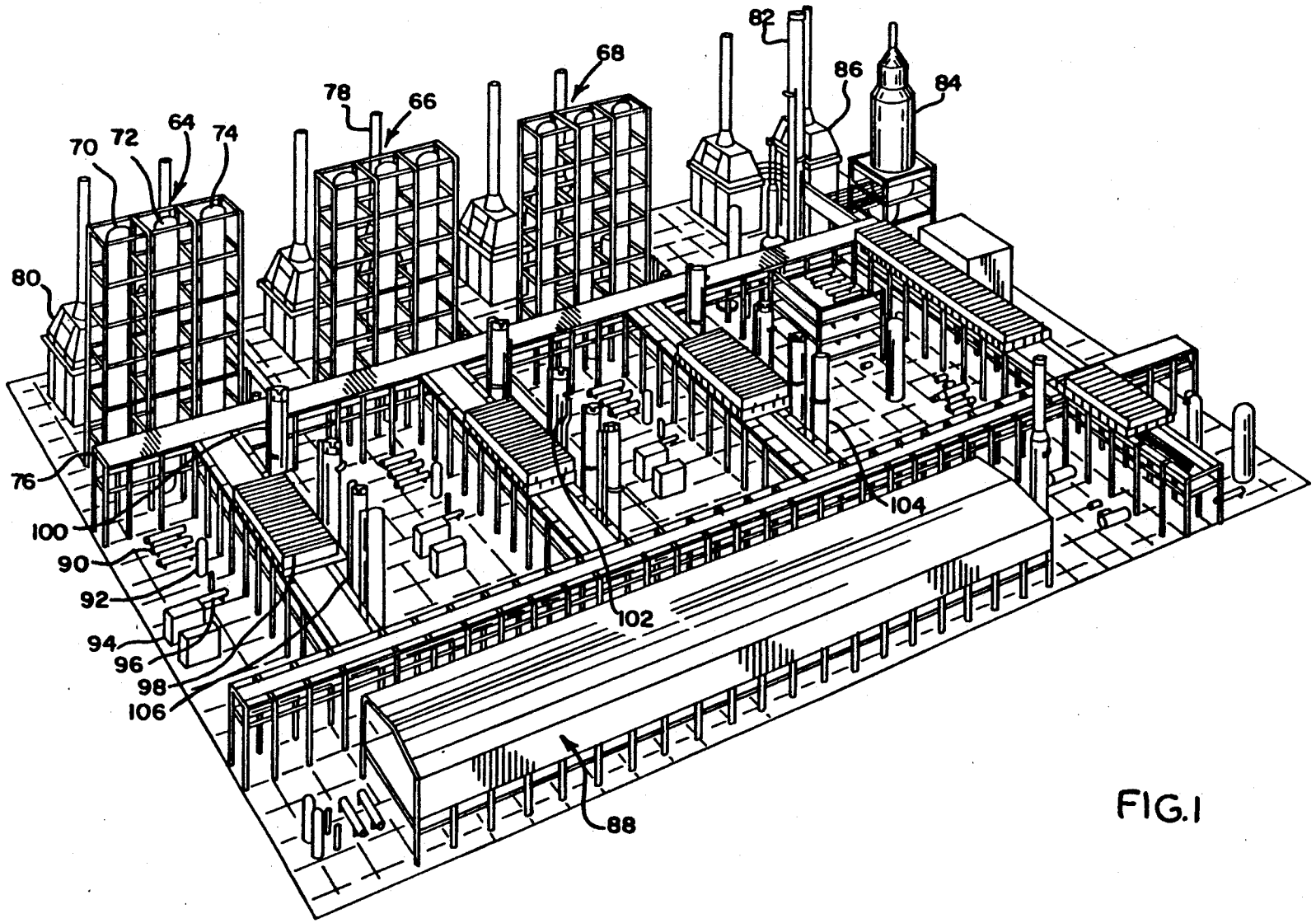
FIG. 1 is a pictorial representation of a resid hydrotreating unit ("RHU") which may use the invention.

By way of example, FIG. 1 shows a resid hydrotreating unit ("RHU") of the Amoco Oil Company, which is located in Texas City, Tex. The inventive separator may be added to this or almost any resid hydrotreating unit.

The resid hydrotreating units and associated refining equipment of FIG. 1 comprise three identical parallel trains of cascaded ebullated bed reactors 70, 72 and 74, as well as hydrogen heaters 78, influent oil heaters 80, an atmospheric tower 82, a vacuum tower 84, a vacuum tower oil heater 86, a hydrogen compression area 88, oil preheater exchangers 90, separators 92, recycled gas compressors 94, flash drums 96, separators 98, raw oil surge drums 100, sponge oil flash drums 102, amine absorbers and recycle gas suction drums 104, and sponge oil absorbers and separators 106.

As shown in FIG. 1, each train of reactors includes resid hydrotreating ebullated bed units 64, 66, and 68. Hydrogen is injected into these ebullated bed reactors through feed line 76. A resid is fed to the reactor where it is hydroprocessed (hydrotreated) in the presence of ebullated (expanded) fresh and/or equilibrium hydrotreating catalyst and hydrogen to produce an upgraded effluent product stream with reactor tail gases (effluent off gases) leaving used spent catalyst. Hydroprocessing in the RHU includes demetallization, desulfurization, denitrogenation, resid conversion, oxygen removal (deoxygenation), hydrotreating, removal of Ramscarbon, and the saturation of olefinic and aromatic hydrocarbons.

A hot separator normally follows the last hydrotreating reactor. This unit operates at a high temperature and high pressure in order to perform the initial splitting of the reactor products. The overhead from this separator includes most of the hydrogen and much of the light oil. This stream can be cooled and flashed in order to further separate the light oils from the more permanent gases (H2, etc.). Then, the light oils are normally routed to an atmospheric distillation tower.

An alternative disposition of this stream is to take it to a downstream hydrotreater without pressure reduction. Following hydrotreatment, this liquid is routed to an atmospheric distillation tower. The liquid stream from the hot separator is routed to the solvent deasphalter. Depending on the pressure in the first separator, it may be desirable to include a second hot separator operating at a lower pressure in order to strip out more of the light ends.

Oils from the deasphalter are suitable for routing to a fluid catalytic cracker, with pre-hydrotreatment as an option. The resins from the deasphalter are suitable for recycling to the resid hydrotreater. The asphaltenes are suitable for use as solid fuel or as feed to a coker.

Many benefits are obtained by deasphalting the resid from a hydrotreating unit, as compared to simply coking that resid. Among other benefits, there are: (1) increased liquid yields; (2) freed-up coker capacity; (3) increased overall resid conversion capacity; (4) reduced carbonaceous solids in the resid hydrotreater; and (5) a possible removal of inorganic fines from of decanted oil which alleviates erosion problems.

According to the inventive process, all of these benefits are retained when a solvent extractor is used to treat the liquid effluent from a flash drum. In addition, there is no need for a vacuum tower to fractionate the hydrotreated bottoms. Therefore, if a new hydrotreater/deasphalter is built, this invention will reduce the capital investment requirements. In existing refineries with resid hydrotreaters, the invention enables the existing vacuum tower on the resid hydrotreater to be used to process additional virgin feeds. Since the atmospheric tower may now have a reduced charge rate, and with the lighter feed provided by the invention, light oils may be used with fewer impurities and with a tighter control of the boiling point. If the existing hydrotreater throughput is already limited by the atmospheric tower throughput, the inventive process reduces that bottleneck and increases the overall capacity of the resid hydrotreating unit.

Figure 2:
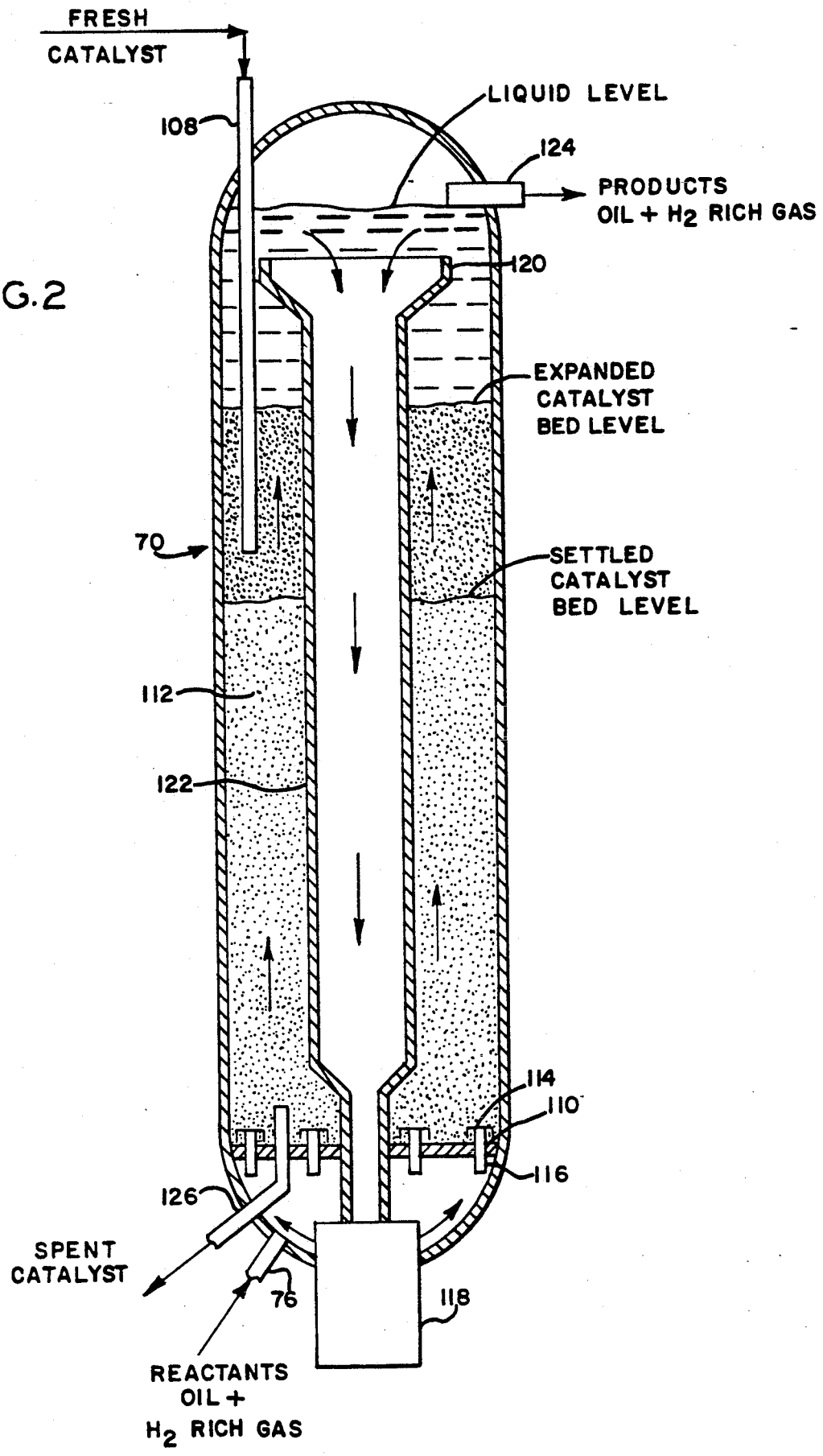
FIG. 2 is a cross-sectional view of an ebullated bed reactor.

FIG. 2 shows an ebullated bed reactor, such as any one of the reactors 70, 72, 74. Fresh hydrotreating catalyst is fed downwardly into the top of the first ebullated bed reactor 7 through the fresh catalyst feed line 108. Hydrogen-rich gases and feed comprising resid, resins, flash drum recycle, and decanted oil, enter the bottom of the first ebullated bed reactor 70 through feed line 76 and flows upwardly through a distributor plate 110 into the fresh catalyst bed 112. The distributor plate contains numerous bubble caps 114 and risers 116 which help distribute the oil and the gas across the reactor. An ebullated pump 118 circulates oil from a recycle pan 120 through a downcomer 122 and the distributor plate 110. The rate is sufficient to lift and expand the catalyst bed from its initial settled level to its steady state expanded level. The effluent product stream of partially hydrotreated oil and hydrogen-rich gases are withdrawn from the top of the reactor through effluent product line 124. The used spent catalyst is withdrawn from the bottom of the reactor through spent catalyst discharge line 126. The spent catalyst typically contains deposits of metals, such as nickel and vanadium, which have been removed from the influent feed oil (resid) during hydrotreating.

Catalyst particles are suspended in a three-phase mixture of catalyst, oil, and hydrogen-rich feed gas in the reaction zone of the reactor. Hydrogen-rich feed gas typically continually bubbles through the oil. The random ebullating motion of the catalyst particles results in a turbulent mixture of the phases which promotes good contact mixing and minimizes temperature gradients.

The cascading of the ebullated bed reactors in a series of three per reactor train, in which the effluent of one reactor serves as the feed to the next reactor, greatly improves the catalytic performance of the back mixed ebullated bed process. Increasing the catalyst replacement rate increases the average catalyst activity.

Figure 3:
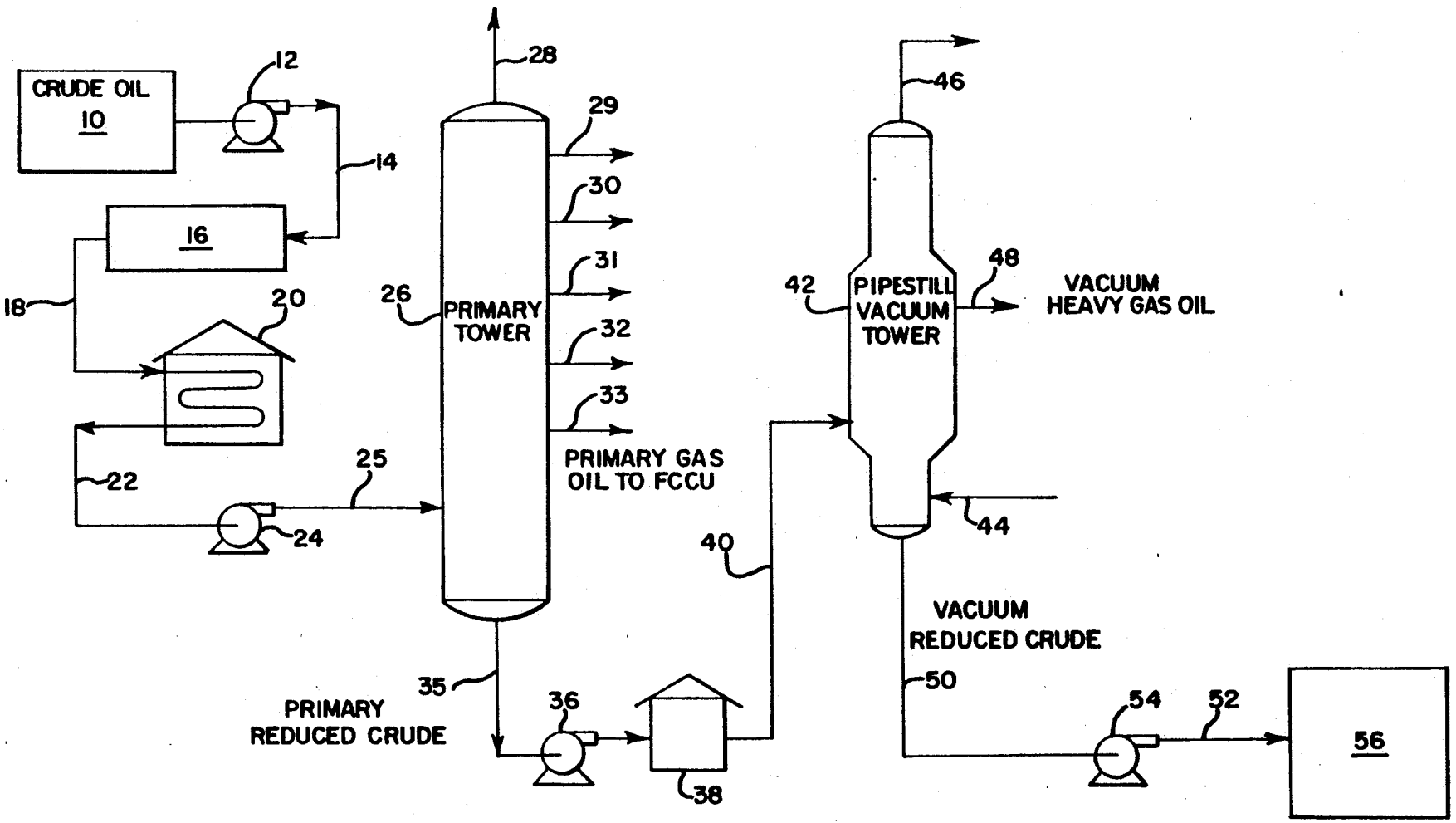
FIG. 3 is a schematic flow diagram for partially refining crude oil.

In refining (FIG. 3), unrefined, raw, whole crude oil (petroleum) is withdrawn from an above ground storage tank 10 at about 75° F. to about 80° F. by a pump 12 and pumped through feed line 14 into one or more desalters 16 to remove particulates, such as sand, salt, and metals, from the oil. The desalted oil is fed through furnace inlet line 18 into a pipestill furnace 20 where it is heated to a temperature, such as to 750° F. at a pressure ranging from 125 to 200 psi. The heated oil is removed from the furnace through exit line 22 by a pump 24 and pumped through a feed line 25 to a primary distillation tower 26.

The heated oil enters the flash zone of the primary atmospheric distillation tower, pipestill, or crude oil unit 26 before proceeding to its upper rectifier section or the lower stripper section. The primary tower is preferably operated at a pressure less than 60 psi. In the primary tower, the heated oil is separated into fractions of wet gas, light naphtha, intermediate naphtha, heavy naphtha, kerosene, virgin gas oil, and primary reduced crude. A portion of the wet gas, naphtha, and kerosene is preferably refluxed (recycled) back to the primary tower to enhance fractionation efficiency.

Figure 4:
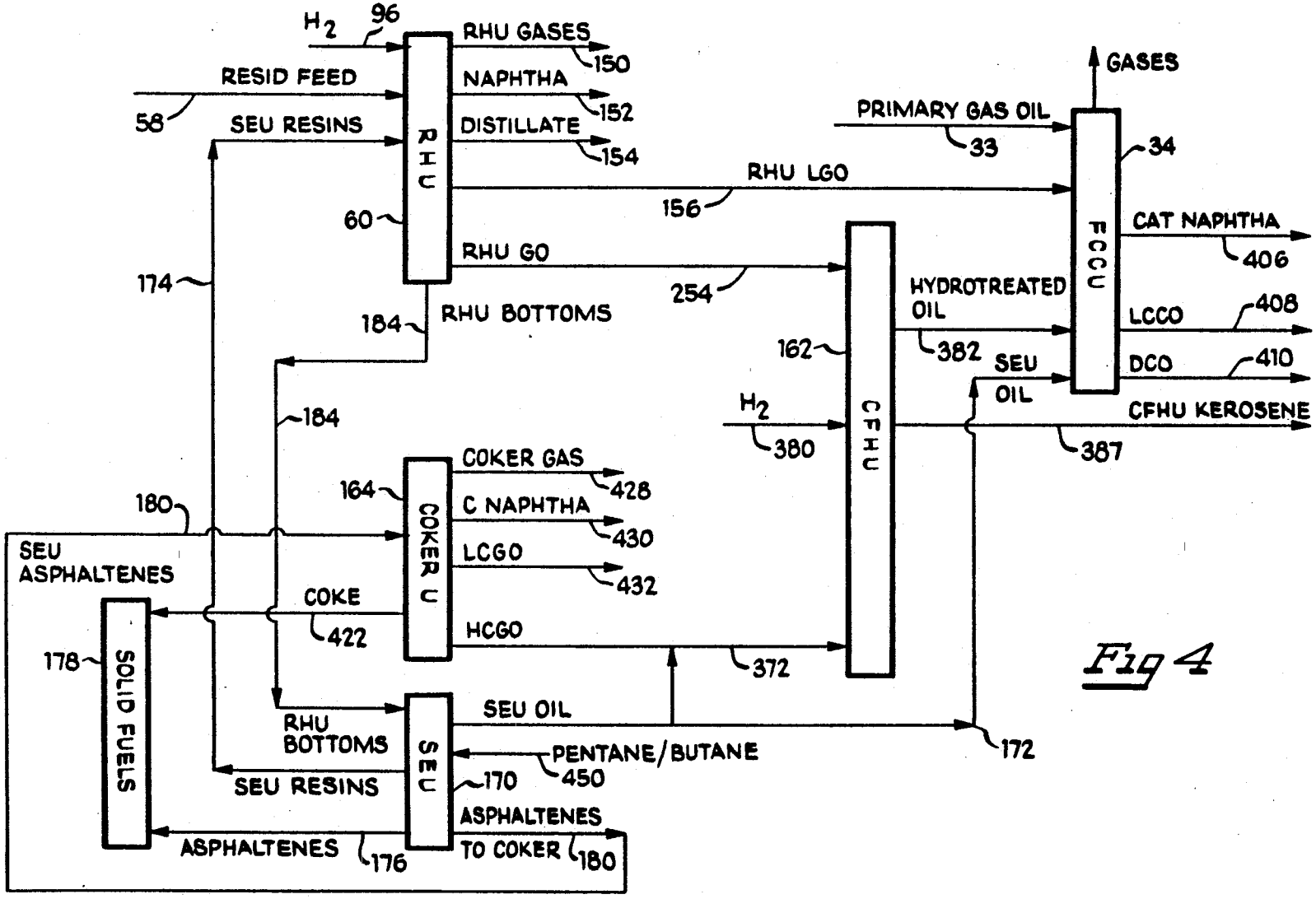
FIG. 4 is a schematic flow diagram of a refinery which may use in the invention.

Wet gas is withdrawn from the primary tower 26 through overhead wet gas line 28. Light naphtha is removed from the primary tower through light naphtha line 29. Intermediate naphtha is removed from the primary tower through intermediate naphtha line 30. Heavy naphtha is withdrawn from the primary tower 26 through heavy naphtha line 31. Kerosene and oil for producing jet fuel and furnace oil are removed from the primary tower through kerosene line 32. Primary virgin, atmospheric gas oil is removed from the primary tower through primary gas oil line 33 and pumped to the fluid catalytic cracking unit (FCCU) 34 (FIG. 4).

Primary reduced crude is discharged from the bottom of the primary tower 26 (FIG. 3) through the primary reduced crude line 35. The primary reduced crude in line 35 is pumped by pump 36 into a furnace 38 where it is heated, such as to a temperature from about 520° F. to about 750° F. The heated primary reduced crude is conveyed through a furnace discharge line 40 into the flash zone of a pipestill vacuum tower 42.

The pipestill vacuum tower 42 is preferably operated at a pressure ranging from 35 to 50 mm of mercury. Steam is injected into the bottom portion of the vacuum tower through steam line 44. In the vacuum tower, wet gas is withdrawn from the top of the tower through overhead wet gas line 46. Heavy and/or light vacuum gas oil are removed from the middle portion of the vacuum tower through heavy gas oil line 48. Vacuum-reduced crude is removed from the bottom of the vacuum tower through vacuum-reduced crude line 50. The vacuum-reduced crude typically has an initial boiling point near about 1000° F.

The vacuum-reduced crude, also referred to as resid, resid oil, and virgin unhydrotreated resid, is pumped through vacuum-reduced crude lines 50 and 52 by a pump 54 into a feed drum or surge drum 56. Resid oil is pumped from the surge drum 56 through resid feed line 58 (FIG. 4) into a resid hydrotreating unit complex 60 (RHU) comprising three resid hydrotreating units and associated refining equipment as shown in FIG. 6.

As shown in FIG. 4, the products produced from the resid feed stream 58 received from the resid hydrotreating units in the ebullated bed reactors include: light hydrocarbon gases (RHU gases) in gas line 150; naphtha comprising light naphtha, intermediate naphtha lines 152; distillate in one or more distillate lines 154; light gas oil in gas oil line 156; heavy gas oils line 254; and flash drum bottoms from line 184.

Light and intermediate naphthas can be sent to a vapor recovery unit for use as gasoline blending stocks and reformer feed. Heavy naphtha can be sent to the reformer to produce gasoline. The mid-distillate oil in line 154 is useful for producing diesel fuel and furnace oil, as well as for conveying and/or cooling the spent catalyst. Resid hydrotreated (RHU) light gas oil is useful a feedstock for the catalytic cracking unit 34. Heavy gas oil can be upgraded in a catalytic feed hydrotreating unit 162 (CFHU). Some of the flash drum bottoms can be sent over line 184 to a solvent extraction unit (SEU) 170 operated with supercritical solvent recovery. Deasphalted solvent extracted oil (SEU oil) in SEU oil line 172 is useful as a feedstock to the catalytic cracking unit 34 (FCCU) which converts heavy oils to more valuable light products. These products include catalytic naphtha 406, which is blended into gasoline, light catalytic cycle oil (LCCO) 408, and decanted oil (DCO) 410, which is often fed to the RHU to suppress the formation of carbonaceous solids.

Deasphalted solvent-extracted resins (SEU resins) in SEU resin line 174 are useful as part of the feed to the resid hydrotreating unit (RHU) 60 in order to increase the yield of more valuable lower-boiling liquid hydrocarbons. A portion of the asphaltenes can be conveyed or passed through an asphaltene line or chute 176 or otherwise transported to a solid fuels mixing and storage facility 178, such as a tank, bin or furnace, for use as solid fuel. Another portion of the solvent-extracted asphaltenes (SEU asphaltenes) can be conveyed or passed through a SEU asphaltene line or chute 180 to the coker 164.

Figure 5:
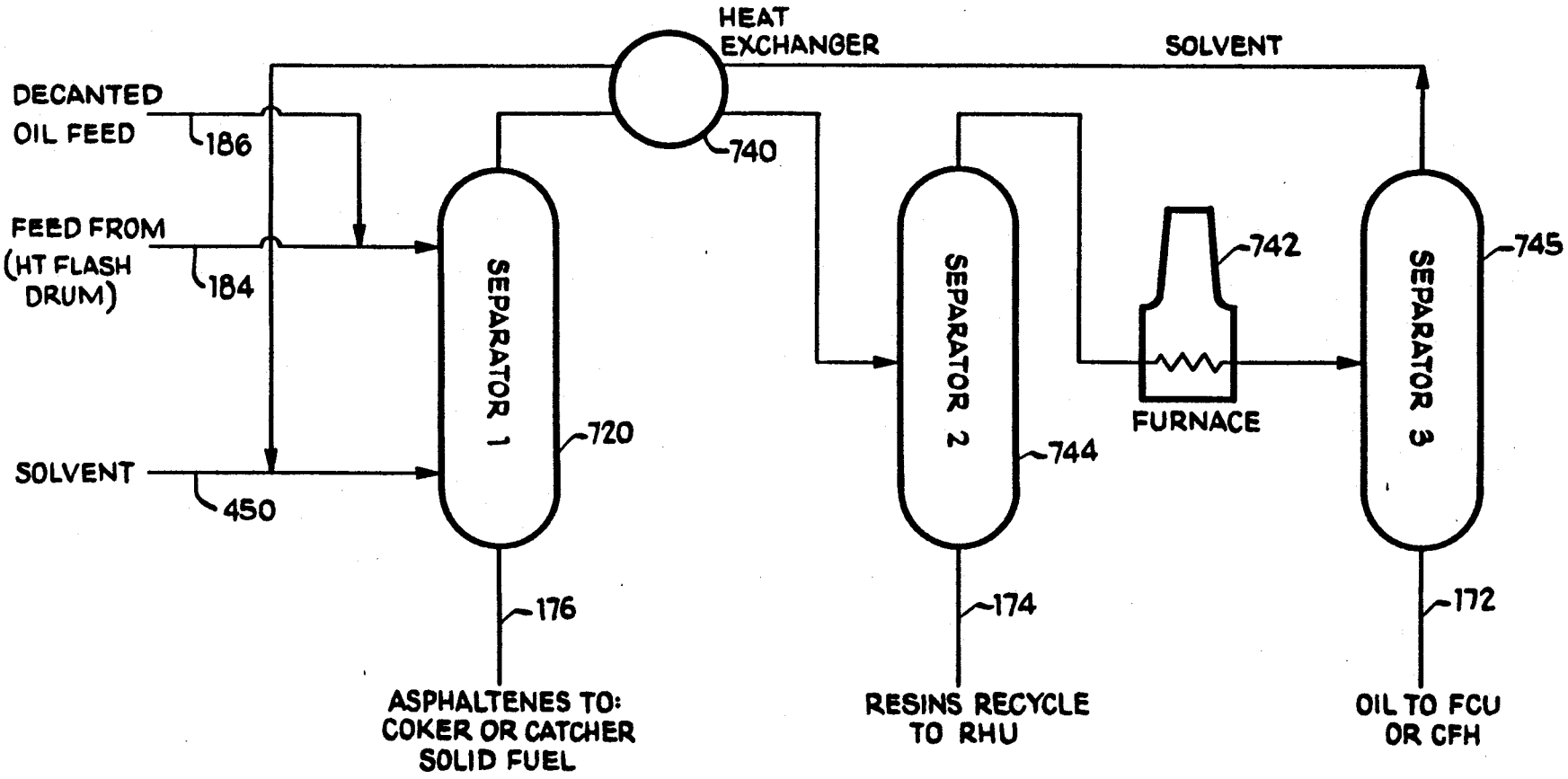
FIG. 5 is a schematic diagram of a solvent extractor for use in a resid hydrotreating unit input.
Figure 5:
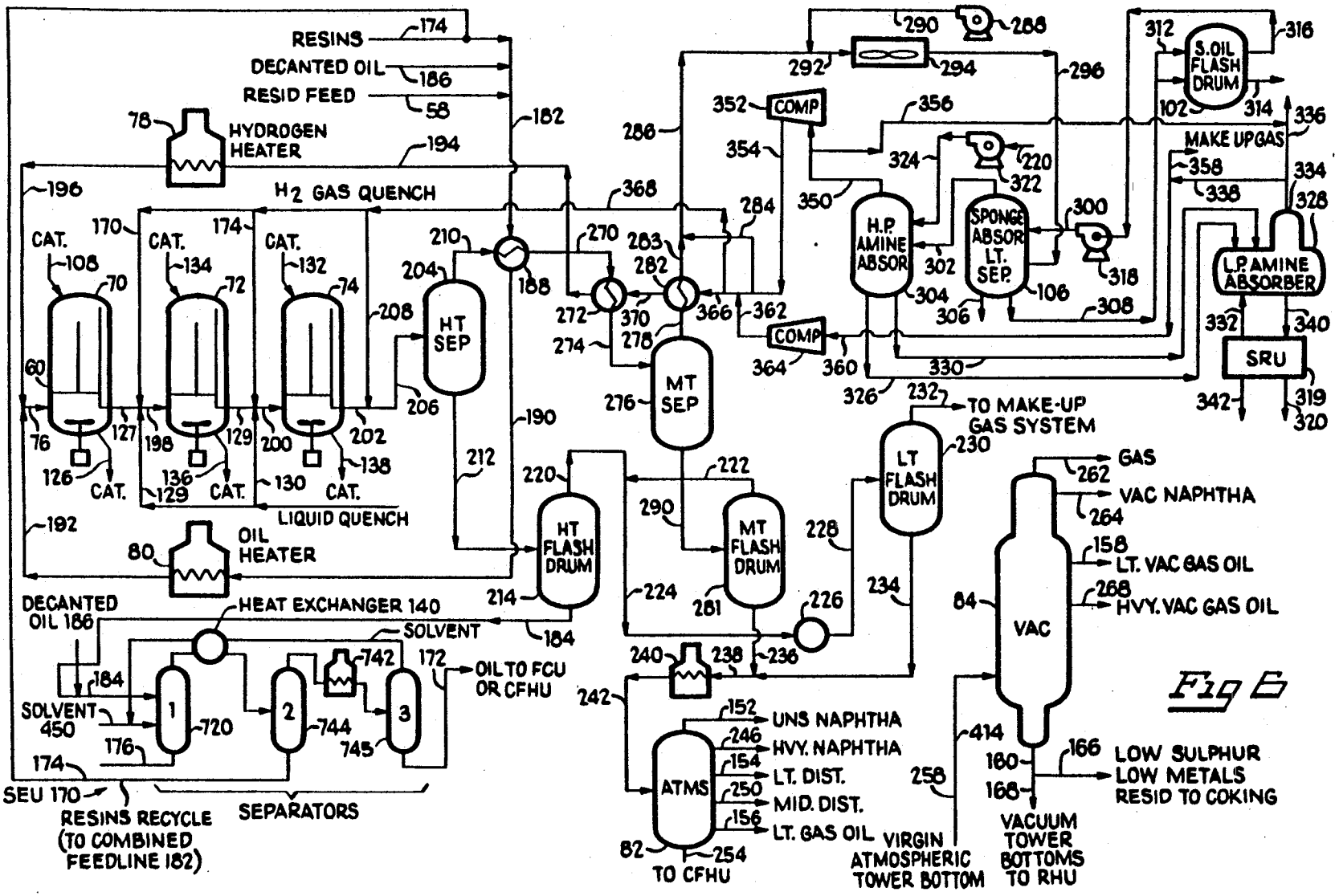

In greater detail, FIG. 5 includes three input feedstreams 186, 184 and 450 which are, respectively, a decanted oil feed from line 410 in FIG. 4, a feed from a flash drum, and a solvent mix of fresh and recycled solvent. The preferred solvent is $C_3$–$C_5$ alkane, with C4 alkane preferred. These feedstreams are fed into a first stage separator 720. The bottom material of the separator 720 is the asphaltene fraction which is fed at line 180 (FIG. 4) to coker, or to calciner 164 or at line 176 to solid fuels 178.

The top material of the first stage solvent separator 720 (FIG. 5) is fed through a heat exchanger 740 to a second solvent stage separator 744. The bottom material from separator 744 is a resin which is recycled to an RHU via line 174. The top material of second stage separator 744 is fed through a furnace 742 to a third stage separator 745. The top material of the third separator 745 is a solvent which is fed back through the heat exchanger 740 and recycled to the solvent input feedstream at 450. Thus, some of the heat in separator 745 is recovered at 740 when this hot solvent transfers its heat to the input stream to separator 744.

The oil fraction material taken from the bottom of separator 745 becomes the input feedstream for further refining. This material is forwarded via conduit 17 to FCCU 34 or CFCU 162 (FIG. 4).

FIG. 6 is a schematic showing of a refining process which is taken from U.S. Pat. No. 5,013,427. In addition, this FIG. 6 has the substance of FIG. 5 added in the lower left-hand corner thereof.

In the past, the atmospheric tower 82 has sometimes become a bottleneck in the system production. Often the bottleneck has been caused by some clogging or other accumulation of solid or very heavy matter. According to the invention, this bottlenecking is relieved by feeding the output from the flash drum 214 through line 184 to a solvent extractor unit 170, as shown in FIGS. 4 and 6.

In greater detail, the input feed stream of resid to the system of FIG. 6 appears on line 58 (upper left-hand corner). The input of resins delivered from SEU 170 appear on line 174, and are combined on line 182. Other sources of input oil may or may not be used, depending upon how the system is set up. Here, flash drum 214 recycled oil appears at 184 of FIG. 6 and decanted oil appears on line 186, also to be mixed in the combined line 182. The feed stream is conveyed through combined line 182 and a preheated feed line 190 to an oil heater 80 where it is heated to a temperature ranging from about 650° F. to 750° F. The heated feed (feedstock) is passed through a heated influent feed line 192 to an oil gas feed line 76.

Hydrogen-containing feed gas in the feed gas line 194 is fed into a hydrogen heater or feed gas heater 78 where it is heated to a temperature ranging from about 650° F. to about 900° F. The feed gas is a mixture of upgraded, methane-lean tail gases (effluent off gases) and hydrogen-rich, fresh makeup gases comprising at least about 95% by volume hydrogen and preferably at least about 96% by volume hydrogen. The feed gas comprises a substantial amount of hydrogen, a lesser amount of methane, and small amounts of ethane. The heated feed gas is conveyed through the heated feed gas line 196 to the gas oil feed line 76 where it is conveyed along with the heated resid oil to the first ebullated bed reactor 70.

Fresh hydrotreating catalyst is fed into the first ebullated bed reactor 70 through the fresh catalyst line 108. Spent catalyst is withdrawn from the first reactor through the spent catalyst line 126. In the first reactor 70, the resid oil is hydroprocessed (hydrotreated), ebullated, contacted, and mixed with hydrogen-rich feed gas in the presence of the hydrotreating catalyst at a temperature of about 700° F. to about 850° F., at a pressure of about 2650 psia to about 3050 psia, and at a hydrogen partial pressure of about 1800 psia to about 2300 psia, thereby producing a hydrotreated (hydroprocessed), upgraded, effluent product stream. The product stream is discharged from the first reactor through the first reactor discharge line 127 and conveyed through the second reactor feed line 198 into the second ebullated bed reactor 72. A liquid quench can be injected into the product feed entering the second reactor through a liquid quench line 129. The liquid quench can be sponge oil. A gas quench can be injected into the product feed before it enters the second reactor through a gas quench line 170. The gas quench preferably comprises a mixture of upgraded, methane-lean tail gases (effluent off gases) and fresh makeup gases.

Hydrotreating catalyst, which may be removed from the third reactor, is fed into the second reactor 72 through an influent catalyst line 134. Used spent catalyst is withdrawn from the second reactor through the second spent catalyst line 136. In the second reactor, the effluent resid oil product is hydroprocessed, hydrotreated, ebullated, contacted, and mixed with the hydrogen-rich feed gas and quench gas in the presence of the hydrotreating catalyst at a temperature of about 700° F. to about 850° F., at a pressure from about 2600 psia to about 3000 psia to produce an upgraded effluent product stream. The product stream is discharged from the second reactor through a second reactor discharge line 128.

The product feed is then fed into the third ebullated bed reactor 74 through a third reactor feed line 200. A liquid quench can be injected into the third reactor feed through an inlet liquid quench line 130. The liquid quench can be sponge oil. A gas quench can be injected into the third reactor feed through an input gas quench line 174. The gas quench can comprise upgraded, methane-lean tail gases and fresh makeup gases. Fresh hydrotreating catalyst is fed into the third reactor through a fresh catalyst line 132. Used spent catalyst is withdrawn from the third reactor through the third reactor spent catalyst line 138. In the third reactor, the resid feed is hydroprocessed, hydrotreated, ebullated, contacted, and mixed with the hydrogen-rich feed gas and quench gas in the presence of the hydrotreating catalyst at a temperature of about 700° F. to about 850° F., at a pressure from about 2550 psia to abut 2950 psia and at a hydrogen partial pressure from about 1600 psia to about 2000 psia to produce an upgraded product stream. The product stream is withdrawn from the third reactor 74 through the third reactor discharge line 202 and fed into a high-temperature, high-pressure separator 204 via inlet line 206. A gas quench can be injected into the product stream in the inlet line through a gas quench line 208 before the product stream enters the high-temperature separator. The gas quench can comprise upgraded, methane-lean tail gases and fresh makeup gases.

The upgraded effluent product streams discharged from the reactors comprise hydrotreated resid oil and reactor tail gases (effluent off gases). The tail gases comprise hydrogen, hydrogen sulfide, ammonia, water, methane, and other light hydrocarbon gases, such as ethane, propane, butane, and pentane.

In the high-temperature (HT) separator 204, the hydrotreated product stream is separated into a bottom stream of high-temperature, hydrotreated, heavy oil liquid and an overhead stream of gases and hydrotreated oil vapors. The high-temperature separator 204 is operated at a temperature of about 700° F. to about 850° F. and at a pressure from about 2500 psia to about 2900 psia. The overhead stream of gases and oil vapors is withdrawn from the high-temperature separator through an overhead line 210. The bottom stream of high-temperature heavy oil liquid is discharged from the bottom of the high-temperature separator through high-temperature separator bottom line 212 and fed to a high-temperature flash drum 214.

In the high-temperature flash drum 214, the influent stream of heavy oil liquid is separated and flashed into a stream of high-temperature vapors and gases and an effluent stream of high-temperature, heavy oil liquid. The flash drum effluent, high-temperature, hydrotreated, heavy resid oil liquid (flash drum liquid effluent) is discharged from the bottom of the flash drum 214 through the high-temperature flash drum bottom line 184. The liquid output comprising the effluent liquid stream of the high temperature flash drum is sent to the separators 720, 744, 745 in the SEU 170, where it is processed as explained above in connection with FIG. 5. Control of the flash drum 214 (FIG. 6) pressure provides some control over the quantity of the distillate which is being passed to the SEU 170. This removal of the heavier fractions (asphaltenes, resins, etc.) greatly relieves the burdens heretofore placed upon and the fouling of the atmospheric tower 82.

Part of the top material from high temperature separator 204 is fed through heat exchangers 188, 272 to the medium temperature separator 276. In the medium-temperature (MT) separator 276, the influent gases and oil vapors are separated at a temperature of about 500° F. and at a pressure of about 2450 psia to about 2850 psia into medium-temperature gases and hydrotreated, medium-temperature liquid. The medium-temperature gases are withdrawn from the top of MT separator 276 through a medium-temperature gas line 278. The medium-temperature liquid is discharged from the bottom of the MT separator through a medium-temperature liquid line 280 and conveyed to a medium-temperature flash drum 281.

In the medium-temperature (MT) flash drum 281, the influent medium-temperature liquid is separated and flashed into medium-temperature vapors and effluent medium-temperature hydrotreated liquid. The medium-temperature flash vapors are withdrawn from the MT flash drum through a medium-temperature overhead line 222 and are injected, blended, and mixed with the high-temperature overhead flash gases and vapors in the combined, common flash line 224 before being cooled in heat exchanger 226 and conveyed to the LT flash drum 230. The effluent medium-temperature liquid is discharged from the MT flash drum 281 through a light oil discharge line 236 and is injected, blended, and mixed with the low-temperature liquid from the LT flash drum in combined, common light oil liquid line 238 before being heated in the light oil heater 240 and conveyed to the atmospheric tower 82.

In the atmospheric tower 82, the hydrotreated, light oil liquid from the oil line 242 can be separated into factions of light and intermediate naphtha, heavy naphtha, light distillate, mid-distillate, light atmospheric gas oil, and atmospheric hydrotreated resid oil. Light and intermediate naphtha can be withdrawn from the atmospheric tower through an unstable naphtha line 152. Heavy naphtha can be withdrawn from the atmospheric tower 82 through a heavy naphtha line 246. Light distillate can be withdrawn from the atmospheric tower through a light distillate line 154. Mid-distillates can be withdrawn from the atmospheric tower through a mid-distillate line 250. Light gas oil can be withdrawn from the atmospheric tower through a light atmospheric gas oil line 156. Heavy gas oil is discharged from the bottom portion of the atmospheric tower through the heavy gas oil line 254 and further upgraded the catalytic feed hydrotreating unit 162 before being processed in the FCCU 34 (FIG. 4).

Accordingly, with solvent extractor unit 170 deasphalting the liquid effluent from the high temperature flash drum 214, the atmospheric tower 82 does not receive any components that are not distillable. Therefore, the liquid throughput of the atmospheric tower is reduced and the tower is less susceptible to fouling.

In vacuum tower 84, additional virgin atmospheric tower bottoms can be separated into gases, vacuum naphtha, light vacuum gas oil, heavy vacuum gas oil, and hydrotreated, vacuum resid oil or vacuum resid. The gases are withdrawn from the vacuum tower 84 through an overhead vacuum gas line 262. Vacuum naphtha can be withdrawn from the vacuum tower through a vacuum naphtha line 264. Light vacuum gas oil (LVGO) can be withdrawn from the vacuum tower through a light vacuum gas oil line 158. Heavy vacuum gas oil (HVGO) can be withdrawn from the vacuum tower through a heavy vacuum gas oil line 268. Vacuum resid oil (vacuum resid) is withdrawn from the bottom of the vacuum tower 84 through a RHU vacuum tower bottoms line 160. Some of the vacuum resid is fed to a coker via a vacuum resid discharge line 166. The rest of the vacuum resid is conveyed to the resid hydrotreating unit (RHU) via a vacuum resid line 168.

Referring again to the high-temperature separator 204 (FIG. 6), high-temperature gases and oil vapors are withdrawn from the high-temperature separator 204 through an overhead vapor line 210 and cooled in a resid feed heat exchanger 188 which concurrently preheats the oil and resin feed in combined line 182 before the oil and resin feed enters the oil heater 80. The cooled vapors and gases exit the heat exchanger 188 and are passed through an intermediate line 270 and cooled in a high-temperature gas quench heat exchanger 272 which concurrently preheats the feed gas before the feed gas passes through the hydrogen heater inlet line 194 into the hydrogen heater 78. The cooled gases and vapors exit the heat exchanger 272 and are passed through a medium-temperature inlet line 274 to a medium-temperature, high-pressure separator 276.

In the medium-temperature (MT) separator 276, the influent gases and oil vapors are separated at a temperature of about 500° F. and at a pressure of about 2450 psia to about 2850 psia into medium-temperature gases and hydrotreated, medium-temperature liquid. The medium-temperature gases are withdrawn from the MT separator through a medium-temperature gas line 278. The medium-temperature liquid is discharged from the bottom of the MT separator through a medium-temperature liquid line 280 and conveyed to a medium-temperature flash drum 281.

In the medium-temperature (MT) flash drum 281, the influent medium-temperature liquid is separated and flashed into medium-temperature vapors and effluent medium-temperature, hydrotreated liquid. The medium-temperature flash vapors are withdrawn from the MT flash drum through a medium-temperature overhead line 222 and injected, blended, and mixed with the high-temperature overhead flash gases and vapors in the combined, common flash line 224 before being cooled in heat exchanger 226 and conveyed to the LT flash drum 230. The effluent medium-temperature liquid is discharged from the MT flash drum 281 through a light oil discharge line 236 and is injected, blended, and mixed with the low-temperature liquid from the LT flash drum in combined, common light oil liquid line 238 before being heated in the light oil heater 240 and conveyed to the atmospheric tower 82.

In the MT separator 276, the medium-temperature effluent gases exit the MT separator through an MT gas line 278 and are cooled in a medium-temperature (MT) feed gas heat exchanger 282 which also preheats the feed gas before the feed gas is subsequently heated in the HT heat exchanger 272 and the hydrogen heater 78.

The cooled medium-temperature gases exit the MT heat exchanger 282 through a medium-temperature (MT) gas line 282 and are combined, blended and intermixed with compressed gas from an anti-surge line 284 in a combined, common gas line 286. The gas and vapors in gas line 286 are blended, diluted and partially dissolved with wash water line 290, in a combined water gas inlet line 292. Ammonia and hydrogen sulfide in the tail gases react to form ammonium bisulfide which dissolves in the injected water. The gas and water products in line 292 are cooled in an air cooler 294 and conveyed through a sponge absorber feed line 296 into a sponge oil absorber and low-temperature (LT) separator 106.

Lean sponge oil is fed into the sponge oil absorber 106 through a lean sponge oil line 300. In the sponge oil absorber, the lean sponge oil and the influent tail gases are circulated in a countercurrent extraction flow pattern. The sponge oil absorbs, extracts, and separates a substantial amount of methane and ethane and most of the $C_3$, $C_4$, $C_5$, and $C_6$ + light hydrocarbons (propane, butane, pentane, hexane, etc.) from the influent product stream. The sponge oil absorber operates at a temperature of about 130° F. and at a pressure of about 2700 psia. The effluent gases comprising hydrogen, methane, ethane, and hydrogen sulfide are withdrawn from the sponge oil absorber through a sponge oil effluent gas line 302 and fed into a high-pressure (HP) amine absorber 304.

Effluent water containing ammonium bisulfide is discharged from the bottom of the sponge oil absorber 106 through an effluent water line 306 and conveyed to a sour water flash drum, a sour water degassing drum, and/or other wastewater purification equipment and recycled or discharged.

Rich sponge oil effluent containing $C_3$, $C_4$, $C_5$, and $C_6$ + absorbed light hydrocarbons is discharged from the bottom portion of the sponge absorber 106 through a rich sponge oil line 308 and conveyed to a sponge oil flash drum 102. Vacuum naphtha and/or middle distillate can also be fed into the sponge oil (SO) flash drum through a sponge-oil naphtha line 312 as a stream to keep a level in the sponge oil system. In the sponge oil flash drum 102, the rich sponge oil is flashed and separated into light hydrocarbon gases and lean sponge oil. The flashed light hydrocarbon gases are withdrawn from the SO flash drum 102 through a gas line 314 and conveyed downstream for further processing. Lean sponge oil is discharged from the SO flash drum 102 through a lean sponge oil discharge line 316 and pumped (recycled) back to the sponge oil absorber via sponge oil pump 318 and line 300. Some of the lean sponge oil can also be used as the liquid quench. The ammonia-lean, $C_3$ + lean reactor tail gases containing hydrogen sulfide, hydrogen, methane, and residual amounts of ethane are fed into the high pressure (HP) amine absorber 304 through an amine absorber inlet line 302. Lean amine from the sulfur recovery unit (SRU) 319 lean amine discharge line 320 is pumped into the HP amine absorber 304 by a lean amine pump 322 through a lean amine inlet line 324. In the HP amine absorber 304, lean amine and influent tail gases are circulated in a countercurrent extraction flow pattern at a pressure of about 2500 psia. The lean amine absorbs, separates, extracts, and removes substantially all the hydrogen sulfide from the influent tail gases.

Rich amine containing hydrogen sulfide is discharged from the bottom of the HP amine absorber 304 through a rich amine line 326 and conveyed to a low-pressure (LP) amine absorber 328. The lean amine absorber 328. The lean amine from the sulfur recovery unit is recycled back to the high-pressure and low-pressure amine absorbers through the lean amine line. Skimmed oil recovered in the HP amine absorber 304 is discharged from the bottom of the HP amine absorber through a high-pressure (HP) skimmed oil line 330 and passed to the LP amine absorber 328. Lean amine from the sulfur recovery unit (SRU) 319 is also pumped into the LP amine absorber 328 through a LP lean amine inlet line 332.

In the LP amine absorber 328, the influent products are separated into gases, rich amine, and skimmed oil. Gases are withdrawn from the LP amine absorber 328 through a gas line 334 and conveyed downstream through line 336 for use as sweet fuel or added to the fresh makeup gas through auxiliary gas line 338. Rich amine is discharged from the LP amine absorber 328 through a rich amine discharge line 340 and conveyed to a sulfur recovery unit (SRU) 319. Skimmed oil can also be withdrawn from the LP amine absorber and conveyed to the SRU 319 through line 340 or a separate line. The sulfur recovery unit can take the form of a Claus plant, although other types of sulfur recovery units can also be used. Sulfur recovered from the tail gases are removed by the tail gas cleanup equipment through sulfur recovery line 342.

In the HP amine absorber 304 of FIG. 6, the lean amine influent absorbs, separates, extracts and removes hydrogen sulfide from the influent stream leaving upgraded reactor tail gases (off gases). The upgraded reactor tail gases comprise about 70% to about 80% by volume hydrogen and about 20% to 30% by volume methane, although residual amounts of ethane may be present. The upgraded reactor tail gases are withdrawn from the high-pressure amine absorber through an overhead, upgraded tail gas line 350 and conveyed to a recycle compressor 352. The recycle compressor increases the pressure of the upgraded tail gases. The compressed tail gases are discharged from the compressor through a compressor outlet line 354. Part of the compressed gases can be passed through an antisurge line 284 and injected into the combined gas line 286 to control the inventory, flow and surging of the medium-temperature gases being conveyed to the sponge oil absorber 106. Other portions of the gases prior to compression can be bled off through a bleed line or spill line 356 and used for fuel gas o for other purposes as discussed below.

Fresh makeup gases comprising at least about 95% hydrogen, preferably at least 96% hydrogen, by volume, from a hydrogen plant are conveyed through fresh makeup gas lines 358, 360, and 362 (FIG. 6) by a makeup gas compressor 364, along with gas from gas line 338, and injected, mixed, dispersed, and blended with the main portion of the compressed upgraded tail gases in a combined, common feed gas line 366. The ratio of fresh makeup gases to compressed recycle tail gases in the combined feed gas line 366 can range from about 1:2 to about 1:4.

About 10% by volume of the blended mixture of compressed, upgraded, recycled reactor tail gases (upgraded effluent off gases) and fresh makeup hydrogen gases in combined feed gas line 366 are bled off through a quench line 368 for use as quench gases. The quench gases are injected into the second and third ebullated bed reactors through the second reactor inlet quench line 170 and the third reactor inlet quench line 174 and are injected into the effluent hydrotreated product stream exiting the third reactor through quench line 208.

The remaining portion, about 90% by volume, of the blended mixture of compressed, upgraded, recycled, reactor tail gases (upgraded off gases) and fresh makeup gases in the combined feed gas line 366 comprise the feed gases. The feed gases in the combined feed gas line 366 are preheated in a medium-temperature (MT) heat exchanger 282 (FIG. 6) and passed through a heat exchanger line 370 to a high-temperature (HT) heat exchanger 272 where the feed gases are further heated to a higher temperature. The heated feed gases are discharged from the HT heat exchanger 272 through a discharge line 194 and passed through a hydrogen heater 78 which heats the feed gases to a temperature ranging from about 650° F. to about 900° F. The heated hydrogen-rich feed gases exit the hydrogen heater 78 through a feed gas line 196 and are injected (fed) through an oil-gas line 76 into the first ebullated bed reactor 70.

Heavy coker gas oil from line 372 (FIG. 4), light vacuum gas oil from the light vacuum gas oil line 158 (FIG. 6), and/or heavy vacuum gas oil from the heavy vacuum gas oil lines 268 (FIG. 6) or 48 (FIG. 3) and possibly solvent extracted oil 172 (FIG. 4) are conveyed into an optional catalytic feed hydrotreater or catalytic feed hydrotreating unit (CFHU) 162 (FIG. 4) where it is hydrotreated with hydrogen from hydrogen feed line 380 at a pressure ranging from atmospheric pressure to 2000 psia, preferably from about 1000 psia to about 1800 psia at a temperature ranging from 650° F. to 750° F. in the presence of a hydro-treating catalyst. The hydrotreated gas oil is discharged through a catalytic feed hydrotreater discharge line 382.

While the system of FIG. 6 is a specific application of the inventive process to the Amoco Oil Texas City RHU, it may also be applied to any suitable process. In this specific application, the recycle lines are replaced with resin recycle from the deasphalting unit. An inclusion of the aromatic fraction of the gas oil stream enhances the value of this stream and also prevents the condensed aromatics (present in significant levels in cracked gas oil stocks) from reaching the FIG. 4 catalytic feed hydrotreating unit 162 (CFHU). These compounds have been identified as problematic in the CFHU. The deasphalted oil is routed either to the CFHU or to the FCCU and the asphalt is sold as solid fuel.

Performance test results from the Texas City RHU show that about 10–20% of the gas oil is feed to the atmospheric tower, rather than being sent to the solvent extraction unit via 184 liquid. Although this material bypasses the solvent extraction unit; it needs less treatment than the gas oil in line 184 liquid needs. For example, it contains an average of 15–20% less nitrogen than the gas oil in line 184 contains.

The liquid from the high temperature separator line 184 liquid includes about 30% of the 360°–650° F. distillate from the RHU. On average, this distillate is heavier and benefits more from treatment than the 70% which is included in the distillate streams 154 and 250. The distillate in line 184 is, on average, about 23% higher in nitrogen than the whole distillate.

The inventive process has the following benefits: (1) increased liquid yields; (2) freed-up coker capacity; (3) increased resid conversion capacity in the resid hydrotreating unit; (4) reduced carbonaceous solids formation and reduced need for decanted oil, thus alleviating erosion problems; (5) increased distillation capacity for virgin stock by freeing up the RHU vacuum tower; (6) reduced problems with coking in the atmospheric tower reboiler; (7) removed bottleneck from RHU by freeing up atmospheric tower; and (8) improved operation of catalytic feed hydrotreater unit because of lower concentration of condensed aromatics in the RHU gas oil, which are now recycled with the resin stream and subjected to higher pressure hydrotreating).

It should be noted that the feed through line 184 to the SEU 170 includes the high temperature separator bottoms, which are substantially a 650+F material. Note also that the high temperature separator bottoms contain substantially all of the carbonaceous solids formed in the RHU 70, 72, 74, which are not cooled significantly before being fed to the SEU. Hence, these solids are extracted before they may foul the product recovery train, particularly to reduce fouling especially at atmospheric tower 82. After the SEU 170 has extracted the solids and other heavy bottom materials, the SEU products may be either returned to resin input line 174, or may be forwarded to the FCCU or CFHU unit via line 172 (FIG. 4).

EXAMPLE 1

Table I compares the RHU reactivities of virgin high sulfur resid, the resins derived from a hydrotreated product, and the resid derived from the hydrotreated effluent. It can be seen that the resins are nearly as reactive or more reactive than the virgin resid for most of the reactions occurring in the RHU. It is also apparent that the hydrotreated resid is far less reactive than the other RHU feeds, demonstrating the benefits of separating the oils and asphaltenes from the hydrotreated product prior to recycling them to the RHU.

TABLE I

Hydrotreating Results For Various Feeds.
(wt % Conversion) (@ 1800 psi hydrogen, 787° F., 0.22LHSV)

| | High Sulfur Resid | Resins | Hydrotreated Resid |
|---|---|---|---|
| % Desulfurization | 80 | 86 | 47 |
| % Ramscarbon Removal | 57 | 66 | 24 |
| % Denitrogenation | 29 | 46 | 14 |
| % 1000° F. + Conversion | 50 | 44 | 19 |

Figure 7:
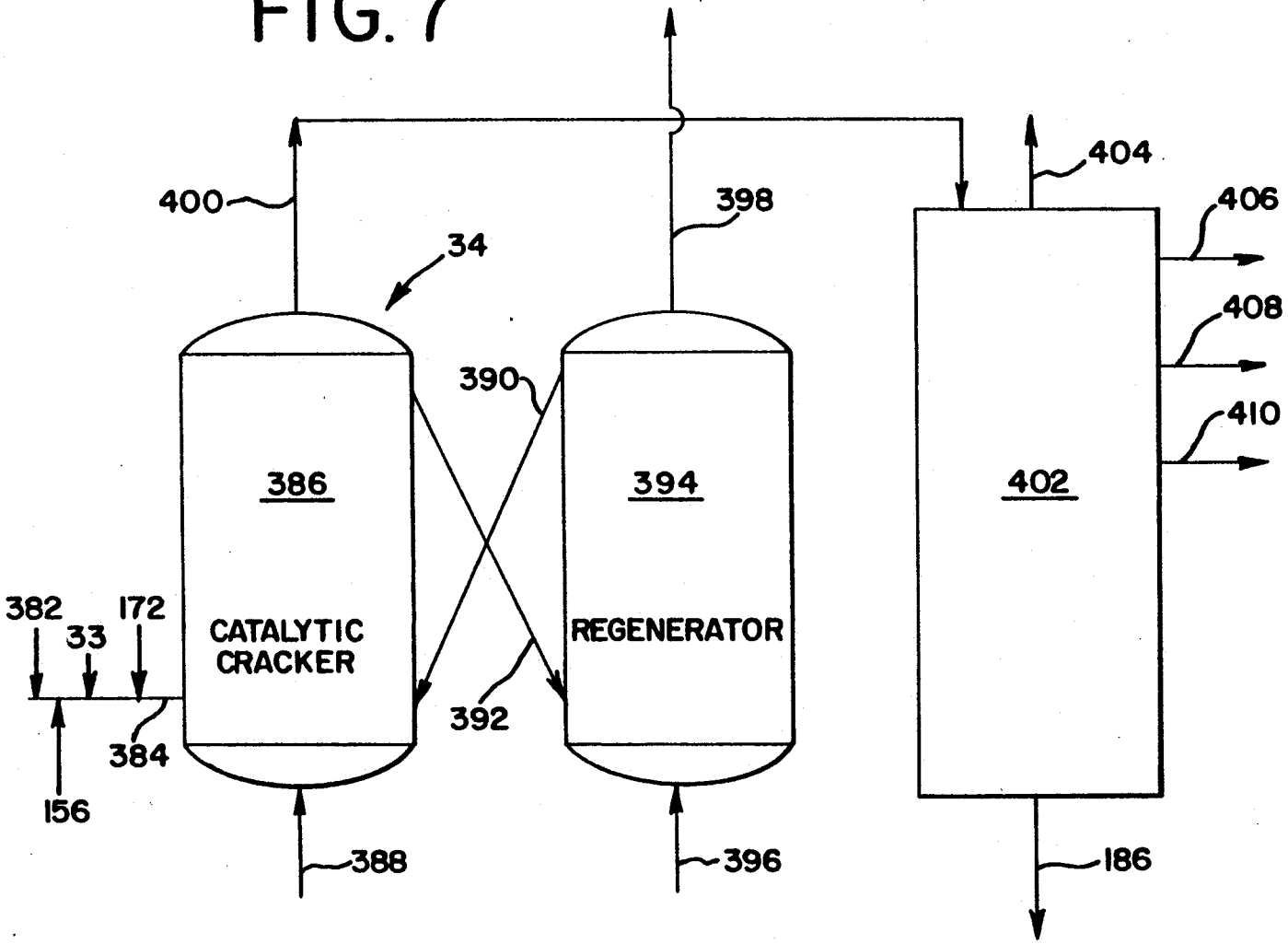
FIG. 7 is a schematic flow diagram of a catalytic cracking unit.

Solvent-extracted deasphalted oil in SEU oil line 172 (FIG. 7) is fed and conveyed via a combined catalytic feed line 384 in the bottom portion of a catalytic cracking (FCC) reactor 386 of a fluid catalytic cracker (FCC) unit 34. Catalytic feed hydrotreated oil in line 382 and light atmospheric gas oil in RHU LGO gas oil line 156 and/or primary gas oil in line 33 from the primary tower 26 (pipestill) (FIG. 3) can also be fed and conveyed via combined catalytic feed line 384 into the bottom portion of the catalytic cracking reactor 386. Kerosene can be withdrawn from the catalytic feed hydrotreating unit 162 (FIG. 4) through CFHU kerosene line 387.

The catalytic cracking reactor 386 (FIG. 7) can have a stripper section. Preferably, the catalytic cracking reactor comprises a riser reactor. In some circumstances, it may be desirable to use a fluid bed reactor or a fluidized catalytic cracking reactor. Fresh makeup catalytic cracking catalyst and regenerated catalytic cracking catalyst are fed into the reactor through a fresh makeup and regenerated catalyst line 390, respectively. In the FCC reactor, the hydrocarbon feedstock is vaporized upon being mixed with the hot cracking catalyst and the feedstock is catalytically cracked to more valuable, lower molecular weight hydrocarbons. The temperatures in the reactor 386 can range from about 900° F. to about 1025° F. at a pressure from about 5 psig to about 50 psig. The circulation rate (weight hourly space velocity) of the cracking catalyst in the reactor 386 can range from about 5 to about 200 WHSV. The velocity of the oil vapors in the riser reactor can range from about 5 ft/sec to about 100 ft/sec.

Spent catalyst containing deactivating deposits of coke is discharged from the FCC reactor 386 (FIG. 7) through spent catalyst line 392 and fed to the bottom portion of an upright, fluidized catalyst regenerator or combustor 394. The reactor and regenerator together provide the primary components of the catalytic cracking unit. Air is injected upwardly into the bottom portion of the regenerator through an air injector line 396. The air is injected at a pressure and flow rate to fluidize the spent catalyst particles generally upwardly within the regenerator. Residual carbon (coke) contained on the catalyst particles is substantially completely combusted in the regenerator leaving regenerated catalyst for use in the reactor. The regenerated catalyst is discharged from the regenerator through regenerated catalyst line 39 and fed to the reactor. The combustion off-gases (flue gases) are withdrawn from the top of the combustor through an overhead combination off-gas line or flue gas line 398.

Suitable cracking catalyst include, but are not limited to, those containing silica and/or alumina, including the acidic type. The cracking catalyst may contain other refractory metal oxides such as magnesia or zirconia. Preferred cracking catalysts are those containing crystalline aluminosilicates, zeolites, or molecular sieves in an amount sufficient to materially increase the cracking activity of the catalyst, e.g., between about 1 and about 25% by weight. The crystalline aluminosilicates can have silica-to-alumina mole ratios of at least about 2:1, such as from about 2 to 12:1, preferably about 4 to 6:1 for best results. The crystalline aluminosilicates are usually available or made in sodium form and this component is preferably reduced, for instance, to less than 4 or even less than about 1% by weight through exchange with hydrogen ions, hydrogen-precursors such as ammonium ions, or polyvalent metal ions. Suitable polyvalent metals include calcium, strontium, barium, and the rare earth metals such as cerium, lanthanum, neodymium, and/or naturally-occurring mixtures of the rare earth metals. Such crystalline materials are able to maintain their pore structure under the high temperature conditions of catalyst manufacture, hydrocarbon processing, and catalyst regeneration. The crystalline aluminosilicates often have a uniform pore structure of exceedingly small size with the cross-sectional diameter of the pores being in the size range of about 6 to 20 angstroms, preferably about 10 to 15 angstroms. Silica-alumina based cracking catalysts having a major proportion of silica, e.g., about 60 to 90 weight percent silica and about 10 to 40 weight percent alumina, are suitable for admixture with the crystalline aluminosilicate or for use as such as the cracking catalyst. Other cracking catalysts and pore sizes can be used. The cracking catalyst can also contain or comprise a carbon monoxide (CO) burning promoter or catalyst, such as a platinum catalyst to enhance the combustion of carbon monoxide in the dense phase in the regenerator 394.

The effluent product stream of catalytically cracked hydrocarbons (volatized oil) is withdrawn from the top of the FCC reactor 386 (FIG. 7) through an overhead product line 400 and conveyed to the FCC main fractionator 402. In the FCC fractionator 402, the catalytically cracked hydrocarbons comprising oil vapors and flashed vapors can be fractionated (separated) into light hydrocarbon gases, naphtha, light catalytic cycle oil (LCCO), heavy catalytic cycle oil (HCCO), and decanted oil (DCO). Light hydrocarbon gases are withdrawn from the FCC fractionator through a light gas line 404. Naphtha is withdrawn from the FCC fractionator through a naphtha line 406. LCCO is withdrawn from the FCC fractionator through a light catalytic cycle oil line 408. HCCO is withdrawn from the FCC fractionator through a heavy catalytic cycle oil line 410. Decanted oil is withdrawn from the bottom of the FCC fractionator through a decanted oil line 186.

Those who are skilled in the art will readily perceive how to modify the invention. Therefore, the appended claims are to be construed to cover all equivalent structures which fall within the true scope and spirit of the invention.

The invention claimed is:

1. A process of relieving downstream burdens and fouling in a resid hydrotreating unit, said method comprising the steps of:

(a) hydrotreating a resid feed stream in at least one ebullated bed reactor;

(b) feeding a high temperature heavy oil liquid component from said reactor to a high temperature flash drum;

(c) feeding a liquid output of said high temperature flash drum to a solvent extraction unit without further distillative fractionation to separate said output into asphaltenes, resins, and oils;

(d) recycling a portion of said resins separated in step (c) to an input of said ebullated bed reactor of step (a); and (e) forwarding a portion of said oils separated in step (c) for further processing in a fluid catalytic cracking unit or a catalytic feed hydrotreating unit.

2. The process of claim 1 and the added steps of feeding medium and low temperature heavy oil liquid components from said reactor to medium and low temperature flash drums, respectively; and feeding liquid outputs of said medium and low temperature flash drums to an atmospheric tower for separation into liquid fractions.

3. The process of claim 2 wherein said liquids fractions separated in said atmospheric tower include naphtha, distillates, and gas oil.

4. The process of claim 1 wherein the separation of step (c) comprises the added steps of:

(c1) feeding said high temperature component from an output of said flash drum and a solvent into a first stage solvent separator;

(c2) feeding an asphaltene-rich phase from said first stage solvent separator; and (c3) feeding an asphaltene-depleted phase from said first stage solvent separator to at least one second stage solvent separator.

5. The process of claim 4 wherein there are three of said solvent separator stages and the added step of taking said oils separated in step (c) from a bottom of a third solvent separator, and of recycling solvent withdrawn from said third stage separator to an input of said first stage separator of step (c1).

6. The process of claim 5 and the added step of exchanging heat between said recycled solvent and said asphaltene-depleted phase fed to said second separator in step (c3).

7. The process of claim 1 wherein said high temperature heavy oil liquid component is separated from a reactor effluent stream by a high temperature separator operating in the approximate range of about 700° F.–850° F.

8. The process of claim 7 wherein the separator operates in the approximate range of about 2500–2900 psia.

9. The process of claim 1 wherein a solvent extraction unit solvent is a $C_3$–$C_5$ alkane, or mixtures thereof.

10. A resid hydrotreating process comprising the steps of:

(a) hydrotreating an input resid feedstream in an ebullated bed reactor to produce an output stream;

(b) separating said output stream into high temperature, medium temperature, and low temperature heavy oil liquid components;

(c) feeding each of said components to individually associated high, medium, and low temperature flash drums, respectively;

(d) without further distillative fractionation feeding a liquid output of said high temperature flash drum to a solvent extraction unit; and (e) feeding liquid outputs form said medium and low temperature flash drums to an atmospheric tower for separation into at least naphtha, distillates, and gas oil.

11. The process of claim 10 and the added steps of: separating said liquid output of said high temperature flash drum into asphaltenes, resins, and oil.

12. The process of claim 11 and the added step of eliminating said asphaltenes separated in said solvent extractor unit of step (d).

13. The process of claim 11 and the added step of recycling said resin into said input feed stream of said ebullated bed reactor.

14. The process of claim 10 wherein step (e) includes the steps of separating said medium and low temperature components in said atmospheric tower into unstable naphtha, heavy naphtha, light distillate, mid-distillates, light atmospheric gas oil, and heavy gas oil.

15. The process of claim 11 wherein the separation of step (d) comprises the added steps of:

(d1) feeding said output of said high temperature flash drum and a solvent into a first stage solvent separator;

(d2) feeding an asphaltene-rich phase from said first stage separator;

(d3) feeding an asphaltene-depleted phase from said first stage separator to at least one second stage solvent separator; and (d4) withdrawing resins from said second stage separator and recycling the resins to said ebullated bed reactor.

16. The process of claim 15 wherein there are three of said solvent separator stages in said solvent extractor unit and the added step of taking oils separated in step (d) from a bottom of third stage solvent separator, and of recycling a solvent phase from a top of said third stage solvent separator to an input of said first stage separator of step (1).

17. The process of claim 16 and the added step of exchanging heat between said recycled solvent and said asphaltene-depleted phase fed from said first stage separator to said second separator.

18. The process of claim 10 wherein said high temperature heavy oil liquid component is separated from a reactor effluent stream by a high temperature separator operating in the approximate range of about 700° F.–850° F.

19. The process of claim 18 wherein the separator operates in the approximate range of about 2500–2900 psia.

20. The process of claim 10 wherein a solvent extraction unit solvent is a $C_3$–$C_5$ alkane, or mixtures thereof.

21. A process for use in a resid hydrotreating unit, said process comprising the steps of:

(a) separating a high temperature heavy oil liquid component of a partially refined liquid output stream of an ebullated bed resid hydrotreating reactor, said separated high temperature component containing at least some bottom materials;

(b) feeding said high temperature component of said partially refined output stream to a high temperature flash drum;

(c) feeding an effluent liquid stream form said flash drum to a solvent extractor unit without further distillative fractionation to separate the stream into asphaltenes, resins, and oils; and (d) recycling said separated resins to an input of said ebullated bed reactor to eventually rejoin said partially refined oil stream of step (a).

22. The process of claim 21 wherein said high temperature component is separated from said liquid output stream in a high temperature separator operating in the approximate range of about 700° F.–850° F.

23. The process of claim 22 wherein the separator operates in the approximate range of about 2500–2900 psia.

24. The process of claim 21 wherein a solvent extraction unit solvent is a $C_3$–$C_5$ alkane, or mixtures thereof.

25. A resid hydrotreating unit process comprising the steps of:

(a) feeding a condensable effluent partially refined resid from a medium and low temperature flash system through an atmospheric tower for fractionating it into lighter components;

(b) feeding a high temperature liquid effluent from partially refined resid from a high temperature flash system to a solvent extraction unit without further distilling the liquid effluent; and (c) extracting heavier components from a liquid effluent produced by said high temperature flash system, said extraction being carried out by a solvent extraction process locate upstream of said atmospheric tower whereby said resid hydrotreating unit is relieved of a bottleneck in said refining because the extracted heavier components do not reach and foul the atmospheric tower.

26. A hydrotreating process comprising the steps of:

(a) substantially desalting crude oil;

(b) heating said desalted crude oil in a pipestill furnace;

(c) pumping said heated crude oil to a primary distillation tower;

(d) separating said heated crude oil in said primary distillation tower into streams of naphtha, kerosene, primary gas oil, and primary reduced crude oil;

(e) pumping said primary reduced crude oil to a pipestill vacuum tower;

(f) separating said primary gas oil in said pipestill vacuum tower into streams of wet gas, heavy gas oil, and vacuum reduced crude oil providing resid oil;

(g) feeding a resid oil feed comprising solvent-extracted resins and said resid oil from said pipestill vacuum tower to a resid hydrotreating unit comprising a series of three ebullated bed reactors;

(h) injecting hydrogen-rich gases into said ebullated bed reactors;

(i) conveying resid hydrotreating catalysts to said ebullated bed reactors;

(j) ebullating said feed comprising said solvent-extracted resins and said resid oil with said hydrogen-rich gases in the presence of said resid hydrotreating catalyst in said ebullated bed reactors under hydrotreating conditions to produce upgraded hydrotreated resid oil;

(k) feeding a high temperature component from an output of said ebullated bed reactor to a high temperature flash drum and liquid effluent from said high temperature flash drum without further distillative fractionation to a first stage solvent separator;

(l) feeding a bottom material from said first stage solvent separator to a solid fuels unit or a coker;

(m) feeding a top material of said first stage solvent separator to at least one second stage solvent separator;

(n) feeding a top material from said second stage solvent to a third stage solvent separator;

(o) withdrawing separated asphaltenes from a bottom of said first stage solvent separator and separated resins from a bottom of said second stage separator;

(p) conveying said solvent-extracted resins from said solvent extraction unit of step (o) to said resid hydrotreating unit as part of said resid oil feed;

(q) withdrawing separated oils from a bottom of said third solvent separator, and recycling solvent withdrawn from said third stage separator to an input of said first stage separator;

(r) feeding medium and low temperature components from said ebullated bed reactor to medium and low temperature flash drums, respectively; and feeding liquid outputs of said medium and low temperature flash drums to an atmospheric tower for separation into liquid fractions, said liquid fractions separated in said atmospheric tower include naphtha, distillates, and gas oil;

(s) separating virgin atmospheric tower bottom material in a resid vacuum tower into vacuum streams of vacuum gas oil and vacuum tower bottoms comprising vacuum resid oil;

(t) conveying and feeding a substantial portion of said vacuum tower bottoms from said resid vacuum tower to a resid hydrotreating unit.

27. The process of claim 26 and the added steps of:

(u) feeding a solvent to said multistage solvent extraction unit of step (t), said solvent comprising a member selected from the group consisting of butane and pentane;

(v) substantially deasphalting and solvent-extracting said vacuum tower bottoms with said solvent in said multistage solvent extraction unit to substantially separate said vacuum tower bottoms into streams of substantially deasphalted solvent-oil, substantially deasphalted solvent-extracted resins, and substantially deresined solvent-extracted asphaltenes;

(w) recovering said solvent under supercritical conditions and recycling said solvent to said solvent extraction unit of step (t); and (x) transporting at least some of said solvent-extracted asphaltenes of step (v) for use as solid fuel.

28. A hydrotreating process comprising the steps of:

(a) feeding a first stream comprising resid to a reactor;

(b) feeding a second stream comprising recycled substantially deasphalted resins to said reactor;

(c) feeding hydrotreating catalyst to said reactor;

(d) injecting hydrogen-rich gases into said reactor;

(e) hydrotreating said first stream comprising resid and said second stream comprising recycled resins with said hydrogen-rich gases in the presence of said hydrotreating catalyst under hydrotreating conditions to produce hydrotreated oil;

(f) feeding a high temperature component in an output stream produced in step (e) to a high temperature flash drum;

(g) solvent separating a nonfractionated liquid output stream from said flash drum of step (f), said separation of step (g) producing asphaltenes, resins, and oil;

(h) fractionating medium and low temperature components produced in step (e) in at least one fractionator to yield distillable liquid products; and (i) recycling said second stream comprising said recycled deasphalted resins to said reactor.

29. The process of claim 28 and the added steps of:

(j) substantially separating said resid bottoms of step (h) into one stream comprising asphaltenes and said second stream comprising said substantially deasphalted resins.

30. A process for hydrotreating a resid feedstock comprising the steps of:

hydrotreating the resid feedstock in an ebullated bed reactor in the presence of a hydrocracking catalyst and hydrogen;

flashing effluent from the reactor to separate the reactor effluent into a volatile fraction and a hydrotreated heavy oil liquid fraction;

transferring the heavy oil liquid fraction to a solvent extraction unit without further distillative fractionation of the heavy oil fraction; and deasphalting the heavy oil fraction in a solvent extraction unit.

31. The process of claim 30 wherein the deasphalted heavy oil fraction is solvent extracted to produce a resin fraction and an oil fraction and wherein the resin fraction si recycled to the ebullated bed reactor.

32. The process of claim 31 wherein the oil fraction is transferred to a catalytic feed hydrotreating unit, a distillation unit or a fluidized catalytic cracking unit.

* * * * *